United States Patent [19]

Overbo

[11] Patent Number: 4,539,785

[45] Date of Patent: Sep. 10, 1985

[54] CAPTIVE COLUMN

[76] Inventor: Gordon I. Overbo, 302 16th Ave. South, Devils Lake, N. Dak. 58301

[21] Appl. No.: 519,980

[22] Filed: Aug. 3, 1983

[51] Int. Cl.[3] ..... E04H 12/16; E04H 12/12; E04C 8/10

[52] U.S. Cl. ..... 52/309.1; 52/222; 52/223 R; 52/309.16; 52/730

[58] Field of Search ..... 52/222, 223 R, 309.1, 52/309.7, 309.16, 637, 648, 653, 730, 727

[56] References Cited

U.S. PATENT DOCUMENTS

| | | | |
|---|---|---|---|
| 2,516,020 | 7/1950 | Reed | 52/730 X |
| 3,111,569 | 11/1963 | Rubenstein | 52/DIG. 7 |
| 3,501,880 | 3/1970 | Bosch | 52/222 |
| 3,765,360 | 10/1973 | Monfort | 52/309.16 X |
| 4,312,162 | 1/1982 | Medney | 52/309.16 |
| 4,331,723 | 5/1982 | Hamm | 52/309.16 X |

*Primary Examiner*—Donald G. Kelly
*Assistant Examiner*—Richard E. Chilcot, Jr.
*Attorney, Agent, or Firm*—Zarley, McKee, Thomte Voorhees & Sease

[57] ABSTRACT

A captive column structure comprising a plurality of spaced-apart elongated column portions having a compression core interconnecting the same. The compression core and column portions are comprised of bonded fibrous material. The fibers are pultruded through a pultrusion machine and bonded with a suitable epoxy material or the like.

5 Claims, 5 Drawing Figures

CAPTIVE COLUMN

BACKGROUND OF THE INVENTION

This invention relates to a captive column and more particularly to an improved captive column.

The concept of a captive column structure is well described in U.S. Pat. No. 3,501,880, which issued to Lawrence Bosch. In U.S. Pat. No. 3,501,880, there is disclosed a captive column structure which is comprised of a plurality of thin elongated columns having a compression core between the columns which is in engagement with each of the columns. A tension skin is wound around the columns and the core so they cannot buckle or move in any direction relative to each other.

The resulting structure disclosed by Bosch is extremely lightweight and strong. However, it has been found that it is extremely difficult to join the core elements to the column elements. Further, it has been found that the core and column elements are not waterproof and lack durability to some degree inasmuch as the components are normally comprised of wood. The construction or fabrication of the Bosch captive column is quite tedious and is expensive.

Therefore, it is a principal object of the invention to provide an improved captive column. A further object of the invention is to provide a captive column structure wherein a plurality of columns are integrally formed with a compression core.

A further object of the invention is to provide a captive column structure which is comprised of bonded fibrious material.

Still another object of the invention is to provide a captive column structure which may be formed in any length by means of a pultrusion process.

Yet another object of the invention is to provide a captive column structure which is durable in use and refined in appearance.

These and other objects will be apparent to those skilled in the art.

SUMMARY OF THE INVENTION

Figure 1:
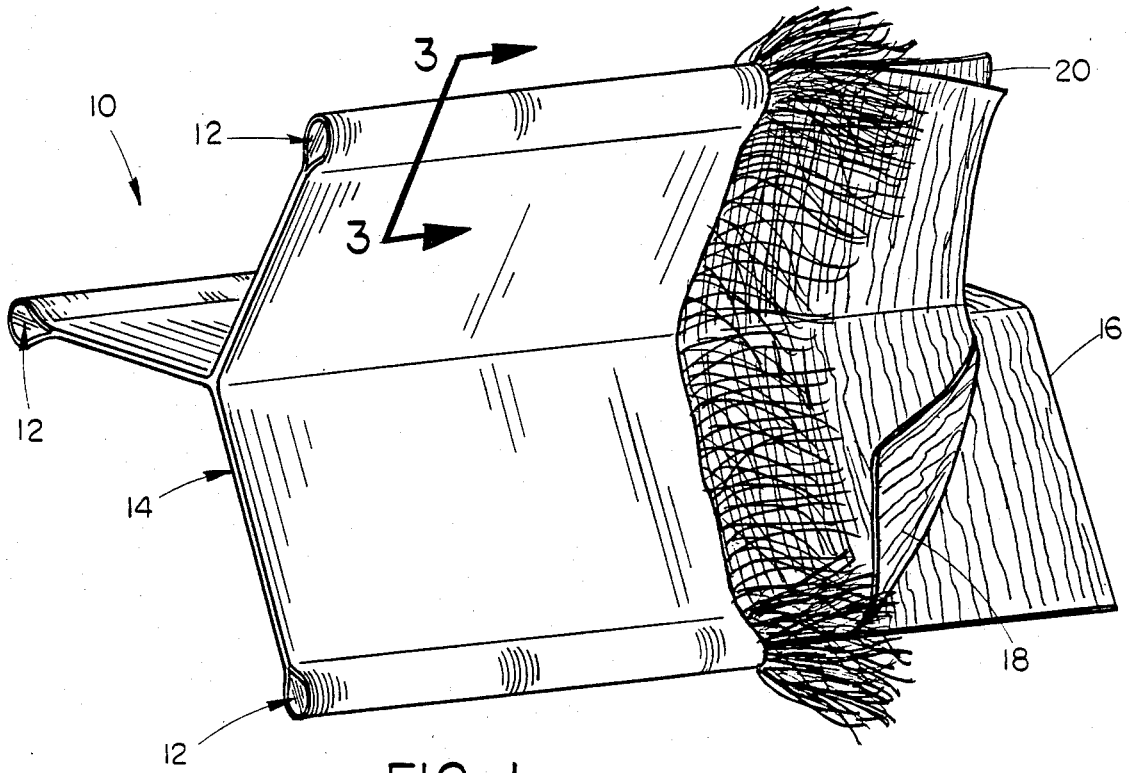
FIG. 1 is a partial perspective view of the captive column of this invention with portions thereof cut away to more fully illustrate the invention.

The captive column structure of this invention is preferably comprised of fibrous material such as fiberglass or the like bonded together by a suitable epoxy adhesive. The fibrous material is fed through an epoxy bath and pultruded through a suitable die to achieve the desired shape and cross-section. The material is then cured and cut to length. The resulting product is a captive column wherein the elongated column portions are spaced apart and are joined by a compression core. Preferably, the fibers of the compression core radiate radially outwardly with the fibers in the column portions extending longitudinally in a continuous fashion.

DESCRIPTION OF THE PREFERRED EMBODIMENT

The captive column structure of this invention is referred to generally by the reference numeral 10 and includes a plurality of spaced-apart column elements 12 interconnected by a compression core 14. Although the drawings show the structure to be comprised of three columns 12, it should be understood that the structure could take practically any shape.

Figure 2:
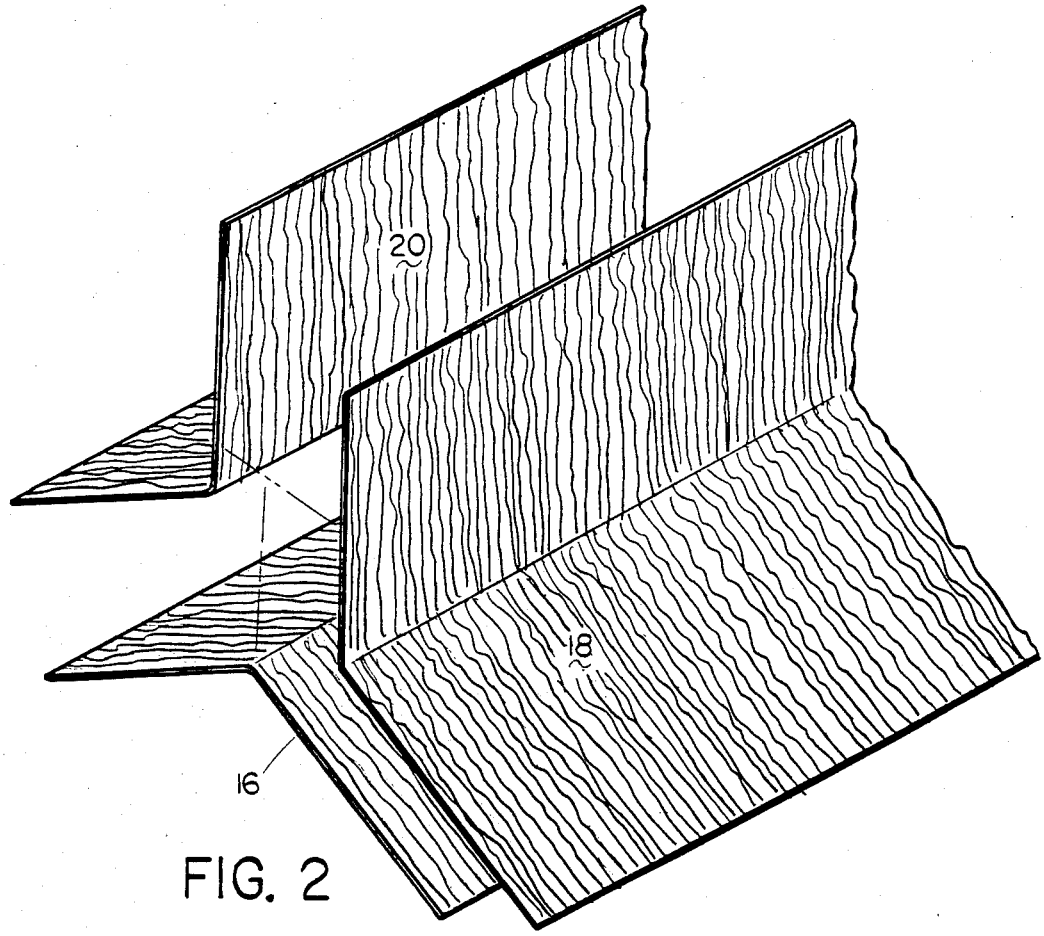
FIG. 2 is a perspective view illustrating the construction of the compression core.
Figure 3:
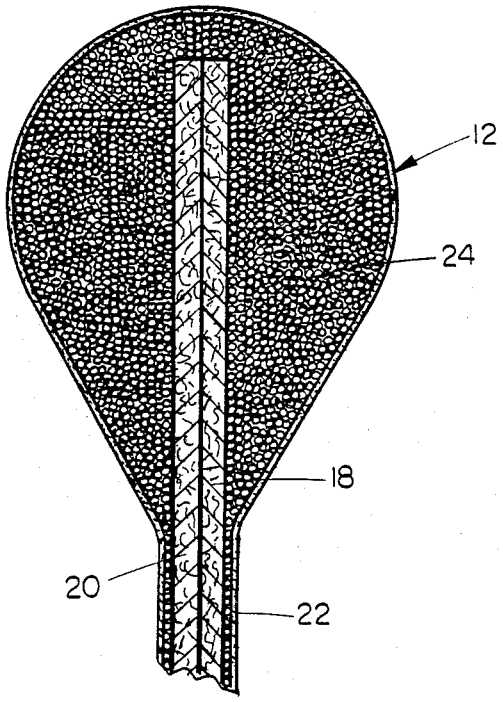
FIG. 3 is an enlarged sectional view seen on lines 3—3 of FIG. 1.

The numerals 16, 18 and 20 refer to "batts" comprised of a fibrous material such as glass fibers as will be described in more detail hereinafter. As seen in the drawings, the fibers in the batts 16, 18 and 20 are arranged so that they are disposed substantially transversely to the longitudinal axis of the column. The batts 16, 18 and 20 are positioned relative to each other as seen in FIG. 2. As best seen in FIG. 3, the ends of adjacent batts extend into the column 12. As also seen in FIGS. 1 and 3, longitudinally extending fibers 22 are positioned on the outer surfaces of the batts 16, 18 and 20. Columns 12 are comprised of continuous, longitudinally extending fibers 24 as illustrated in FIG. 3.

Figure 4:
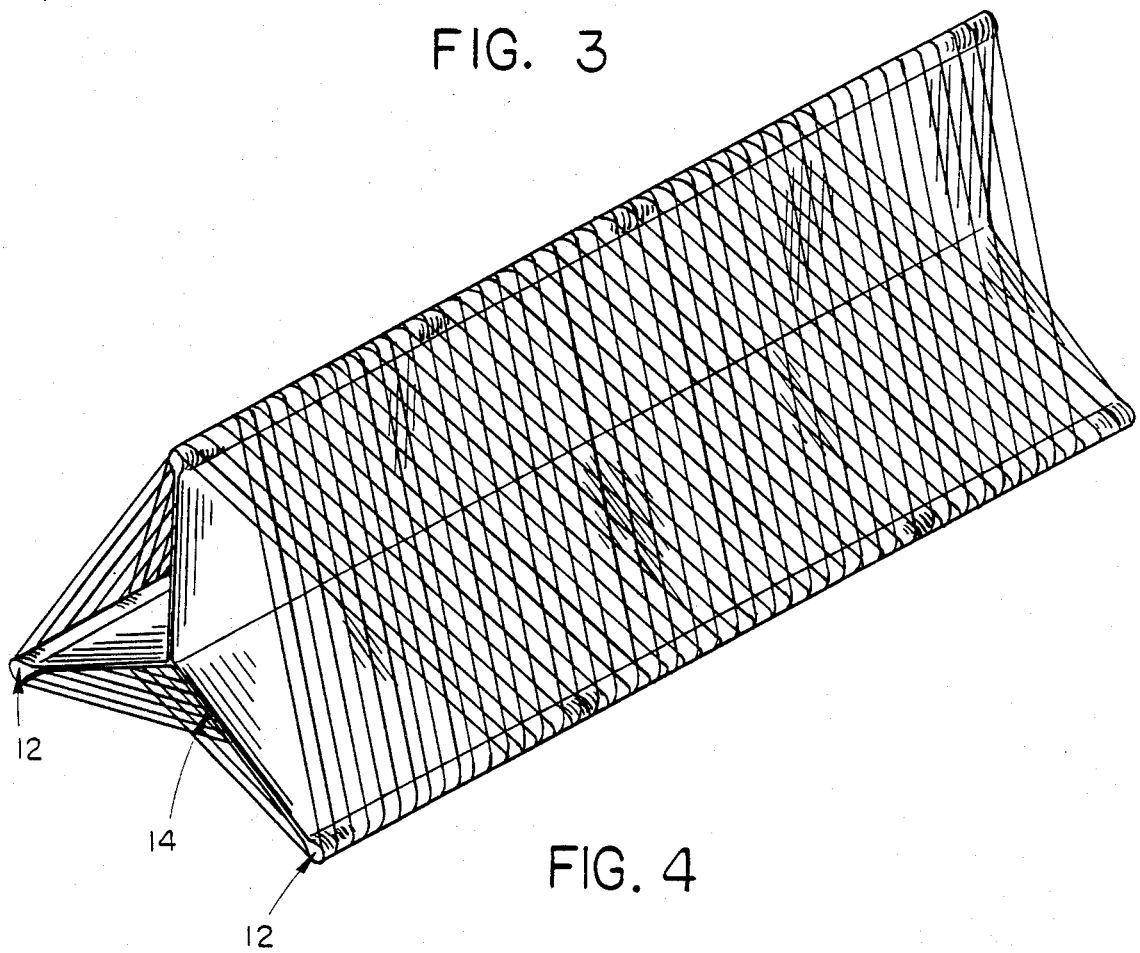
FIG. 4 is a perspective view illustrating the captive column structure of this invention wound with a helical winding.
Figure 5:
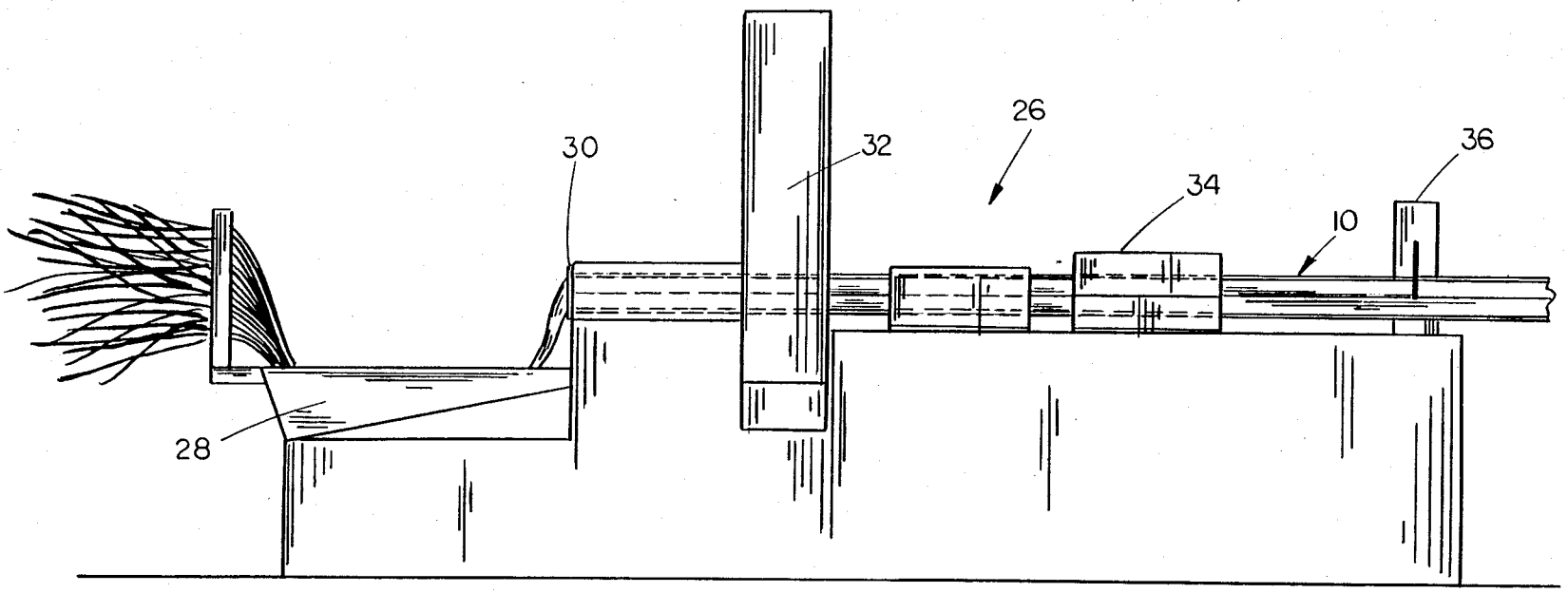
FIG. 5 is a schematic view of the pultrusion machine used to form the captive column structure of this invention.

The structure 10 is formed in the pultrusion machine, not forming a part of this invention, seen in FIG. 5 and illustrated by the reference numeral 26. The fibers or rovings are fed into the intake end of the machine at the left side of FIG. 5 and are bathed in an epoxy resin bath 28. Any suitable type of epoxy resin material may be used to bond the fibers together. The bathed fibers are then introduced into a die 30 to form the desired configuration of the column. The numeral 32 refers to the curing area of the machine 26 where the parts are cured by radio frequency, hot oil, etc. The numeral 34 refers to the puller assembly which pulls the fibers through the bath 28, die 30 and curing area 32. A saw 36 is provided at the discharge end of the machine 26 for sawing the column 10 to the proper length. The column 10 is then wound in the helical illustrated in FIG. 4 and as described in U.S. Pat. No. 3,501,880.

It can be seen in FIG. 3 that the bathing of the fibers in the resin bath and then curing the same results in an unitary structure so that the column elements are positively interconnected to the compression core. The structure of the captive column is such that the column elements cannot buckle or move relative to one another and an extremely durable but yet lightweight structure is provided. In the present invention, the continuous fibrous structure of the columns is very advantageous because loading of the columns will travel the full length of the structure in either compression or tension in practically all loadings. It is also very important to have the compression core material joined well to the columns so that there is absolutely no play or movement between the parts. The compression in most cases takes compression loading, especially at the point of loading and it is therefore very important that movement between the parts be eliminated. Thus, with the pultrusion process, material may be used for the compression core having the ability to take compression. The fibers which may be used in the construction of the captive column herein may be boron, steel, graphite, fiberglass, or any combination of the same. Thus it can be seen that the captive column of this invention accomplishes at least all of its stated objectives.

I claim:

1. A captive column structure comprising, a plurality of spaced-apart elongated column portions, a compression core interconnecting with said column portions, said compression core and said column portion being substantially comprised of bonded fibrous material, the fibrous material of said column portions and compression core being integrally bonded by resin into a unitary structure.

2. The captive column structure of claim 1 wherein the fibrous material of said column portions includes fibers extending longitudinally of the column portions.

3. The captive column structure of claim 2, wherein the fibers in said column portions are continuous throughout the length of said column portions.

4. The captive column structure of claim 2 wherein the fibrous material of said compression core includes fibers directed substantially transversely to the longitudinal axes of the column portions.

5. The captive column structure of claim 4 further comprising a layer of longitudinally extending fibers on the outer surfaces of the fibrous material of said compression core.

* * * * *